US006394873B1

(12) United States Patent
Bernard

(10) Patent No.: US 6,394,873 B1
(45) Date of Patent: May 28, 2002

(54) BALLOON SUSPENSION DEVICE

(76) Inventor: Robina B. Bernard, 78 Cliffside Dr., Huttonville, Ontario (CA), L0J 1B0

( * ) Notice: Subject to any disclaimer, the term of this patent is extended or adjusted under 35 U.S.C. 154(b) by 28 days.

(21) Appl. No.: 09/635,789

(22) Filed: Aug. 11, 2000

(51) Int. Cl.[7] ..... A63H 3/06
(52) U.S. Cl. ..... 446/220; 248/323; 248/342; 211/13
(58) Field of Search ..... 446/220; 248/176.1, 248/176.3, 317, 323, 342, 343, 339, 340; 24/304; 211/13, 14

(56) References Cited

U.S. PATENT DOCUMENTS 3,327,376 A 6/1967 Freeman et al.
5,031,908 A * 7/1991 Spector ..... 446/220
5,036,985 A 8/1991 Lovik
5,074,510 A * 12/1991 Metz ..... 446/220
5,564,575 A 10/1996 Casement

* cited by examiner

*Primary Examiner*—Jacob K. Ackun
(74) *Attorney, Agent, or Firm*—Arne I. Fors

(57) ABSTRACT

A balloon suspension device for a plurality of air-filled balloons for simulating a cluster of lighter-than-air balloons. An elongated rod suspended vertically supports a plurality of horizontal brackets slidably mounted thereon, each bracket having a flange for attachment of a balloon. A weight tethered to the balloons gives the impression the balloons are floating.

6 Claims, 2 Drawing Sheets

BALLOON SUSPENSION DEVICE

BACKGROUND OF THE INVENTION (i) Field of the Invention

This invention relates to a novel balloon suspension device, and, more particularly, relates to a balloon suspension device for simulating a cluster of lighter-than-air balloons.

(ii) Description of the Related Art

Helium-filled balloons are lighter than air and must be tethered by strings to prevent their escape. A cluster of floating lighter-than-air balloons are aesthetically more pleasing than air-filled balloons which droop when tethered by strings. The helium gas in helium-filled balloons migrates through the fabric of the balloons within a week causing the balloons in a cluster to collapse. On the other hand, air is relatively slow in migrating through the balloon fabric and is a preferred gas for expanding balloons in that air-filled balloons remain inflated for several weeks or months.

Balloon and novelty retailers display fully-inflated displays of foil balloons to generate customer demand for their products. Foil balloons inflated with helium for example float gracefully and are more attractive than balloons filled with air. However, the loss of helium gas through the balloon fabric within several days soon renders the balloons unattractive necessitating refilling of the balloons. Each refill reduces the balloon float time by one half and after about four refills the balloons are discarded. The cost to the retailers can be substantial and the refilling of the balloons is a nuisance.

It is a principal object of the present invention accordingly to provide a balloon suspension device for supporting a cluster of air-filled balloons to simulate a cluster of floating, lighter-than-air balloons.

It is another object of the invention to substitute air for the inflating of balloons to avoid the frequent refilling of helium-filled balloons.

SUMMARY OF THE INVENTION

In its broad aspect, the balloon suspension device of the invention comprises an elongated rod having suspension means at one end for suspending the rod substantially vertically, and a plurality of brackets having proximal ends and distal ends with a key-hole slot formed in the proximal ends for slidably mounting the brackets on the rod at the proximal ends thereof for axial and angular adjustment of the brackets on the rod, each bracket having a flange formed at its distal end for removably attaching a balloon thereto. Preferably, double-sided adhesive or hook and loop fasteners are provided on each bracket flange for removably attaching a balloon thereto. The elongated rod preferably has a threaded connection at an end opposite the suspension means for removably connecting another like elongated rod thereto. A weight preferably in the shape of a bow is tethered to each balloon by a coloured ribbon attached at one end to the tail of a balloon and at the other end to the center of the bow. Each ribbon is drawn out to give the impression that the bow is tugging and holding down lighter-than-air balloons.

BRIEF DESCRIPTION OF THE DRAWING

These objects of the invention will become apparent from the following detailed description of the accompanying drawings, in which.

DESCRIPTION OF THE PREFERRED EMBODIMENT

Figure 1:
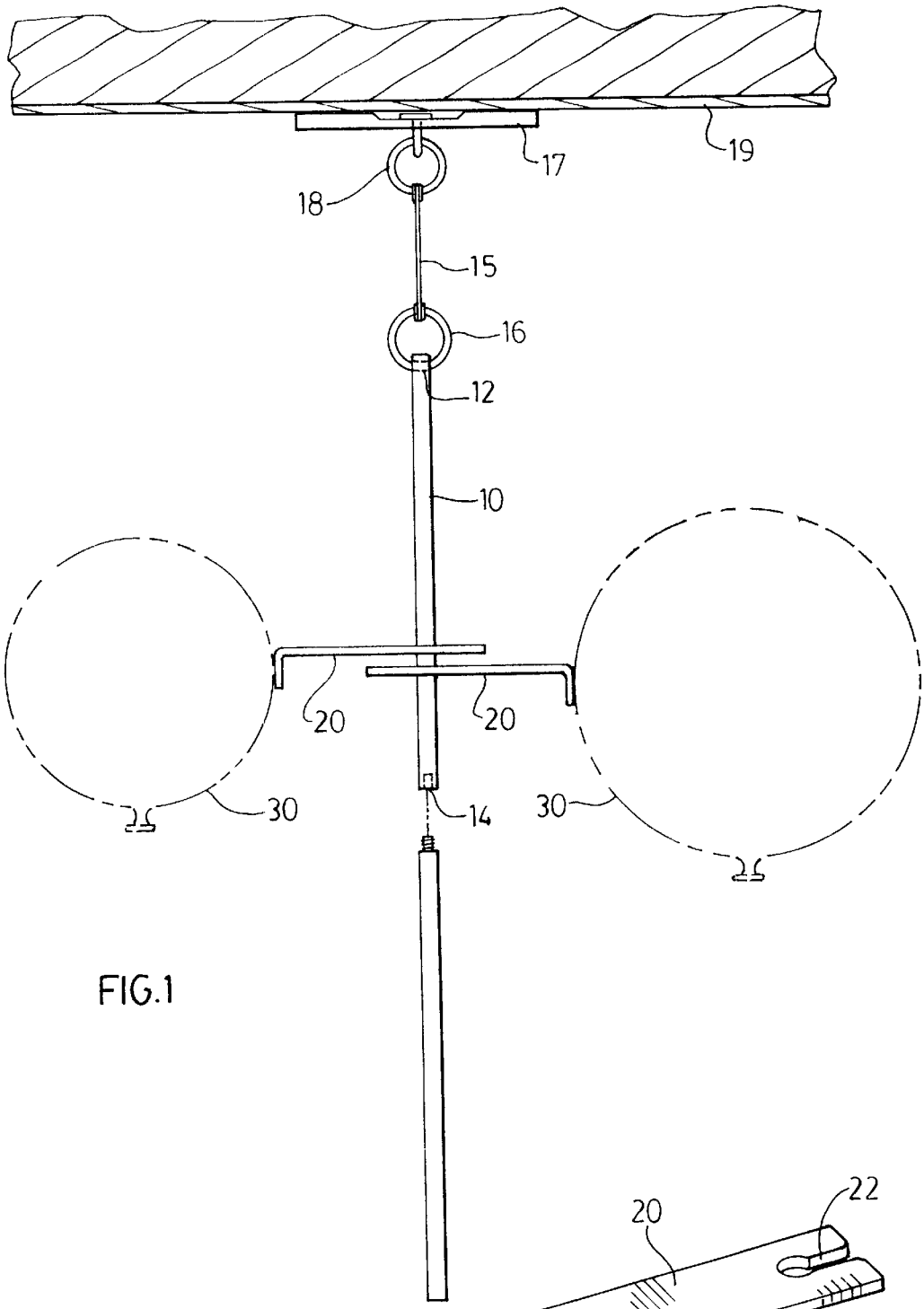
FIG. 1 is an elevation of a preferred embodiment of the present invention showing balloons attached thereto.
Figure 2:
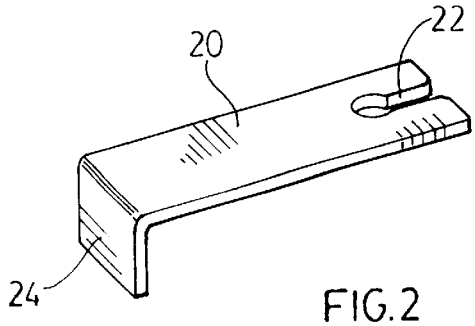
FIG. 2 is a perspective view of a bracket of the invention.
Figure 3:
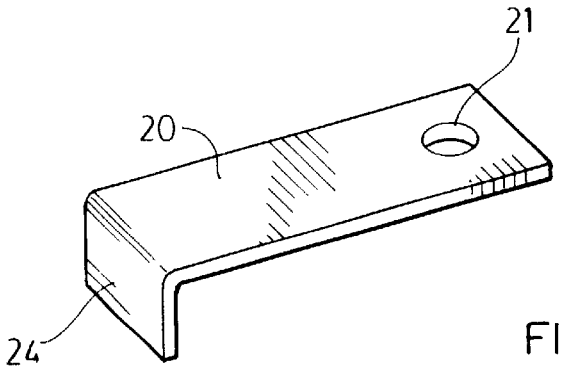
FIG. 3 is a perspective view of another bracket of the invention.

With reference to FIGS. 1, 2 and 3 of the drawings, the balloon suspension device of the invention comprises an elongated thin cylindrical rod 10 having a transverse opening 12 formed in proximity to one end and a threaded socket 14 formed in the opposite end. Rod 10 preferably is formed from a plastic material such as DELRIN™, manufactured by E I DuPont De Nemours and Company, or from wood or aluminum alloy.

A ring 16 such as a stainless steel split ring is fitted into transverse opening 12 to permit suspension of rod 10 by a string or wire 15 from a ceiling support such as a magnet anchor 17 having a ring 18 depending therefrom attached to magnetic strip 19.

A plurality of laterally extending brackets 20 having holes 21 or key-hole slots 22 at a proximal end to permit a snug sliding or snap-fit onto rod 10 and short perpendicular flanges 24 at the distal end for attachment to a balloon are slidably mounted on rod 10. Brackets 20 preferably are formed of a slightly flexible plastics material such as polycarbonate. Brackets 20 may be extensible.

Balloons depicted by ghost lines 30 are attached to bracket flanges 24 by a contact cement or adhesive tape such as double-sided tape manufactured by Minnesota Mining and Manufacturing Company and sold under the mark Scotch™ transfer adhesive 905 or by hook and loop fasteners attached to the balloons and brackets by double-sided tape. The balloons on the brackets can be slid axially along rod 10 to a desired location and adjusted angularly about rod 10, the weight of the balloons on the distal ends of the brackets 20 locking the brackets on the rod 10.

Figure 4:
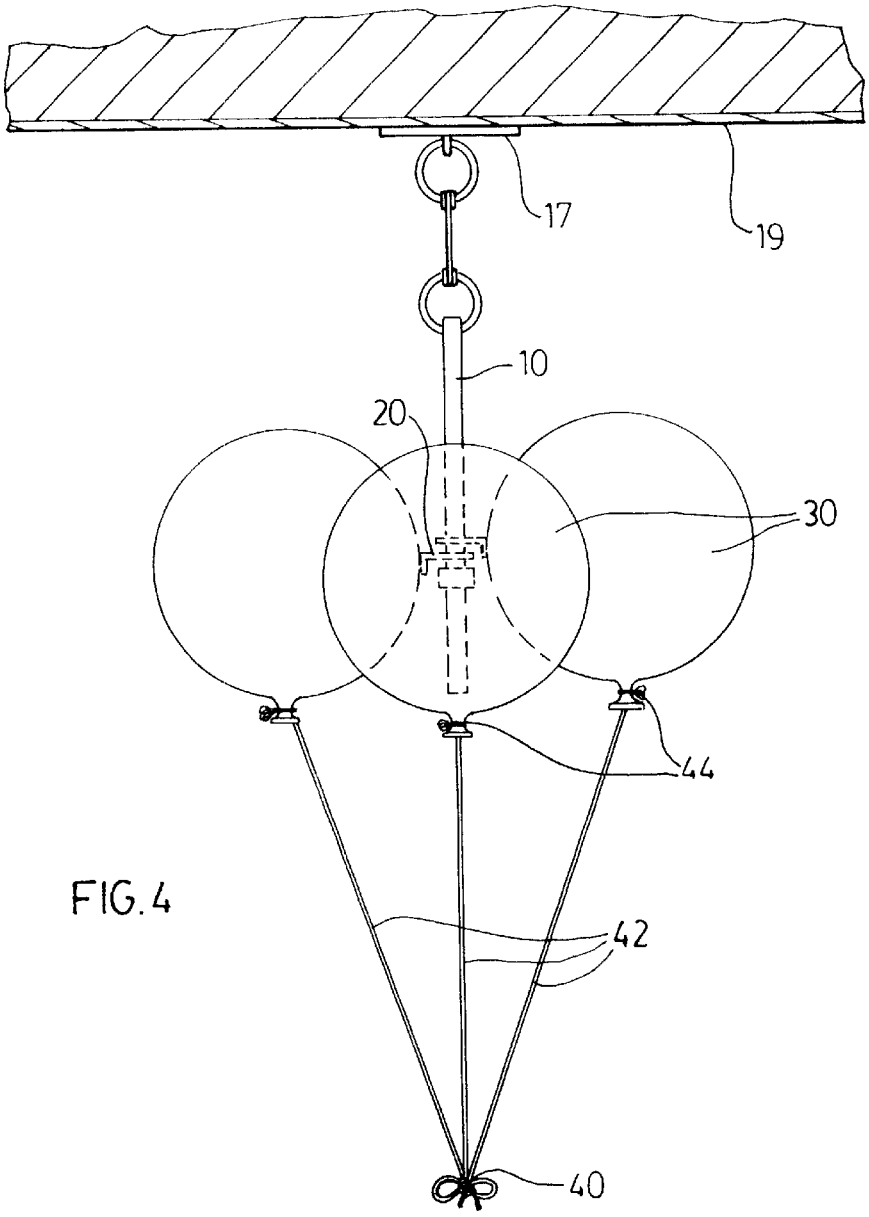
FIG. 4 is a perspective view of a cluster of balloons with a bow and ribbons.

Turning to FIG. 4, three balloons 30 are shown mounted at substantially the same level on rod 10 suspended by a magnet anchor 17 from magnetic steel ceiling strip 19. A weight 40 in the shape of a bow has a central opening for the attachment of ribbon 42 to the tails 44 of the balloons. Each ribbon is drawn equally taut to lightly tug at the balloons such that the ribbons are straight and give the visual impression to the viewer of the ribbons holding down lighter-than-air helium balloons. Three angularly equi-spaced balloons positioned at about the same axial location on rod 10 give the perception of a cluster of floating lighter-than-air balloons.

The present invention provides a number of important advantages. Balloons such as latex or foil balloons can be filled with air instead of helium to avoid the frequent refilling of balloons. The air-filled balloons supported by the suspension device of the invention simulate floating balloons and permit arrangements of balloons in aesthetic clusters. The suspension device is simple in construction and can be easily assembled.

It will be understood, of course that modifications can be made in the embodiment of the invention illustrated and described herein without departing from the scope and purview of the invention as defined by the appended claim.

What is claimed is:

1. A balloon suspension device comprising an elongated rod having suspension means at one end for suspending the rod substantially vertically, and a plurality of brackets having proximal ends and distal ends with a hole or key-hole slot formed in the proximal ends for slidably mounting the brackets on the rod at the proximal ends thereof for angular and axial adjustment of the brackets on the rod, each bracket having a flange formed at its distal end for removably attaching a balloon thereto.

2. A balloon suspension device as claimed in claim 1 additionally comprising double-sided adhesive tape or hook and loop fasteners on each bracket flange for removably attaching of a balloon thereto.

3. A balloon suspension device as claimed in claim 2 additionally comprising a weight and flexible attachment means for attaching the weight to a tail of at least one balloon.

4. A balloon suspension device as claimed in claim 1 in which the elongated rod has a threaded connection at an end opposite the suspension means for removably connecting another like elongated rod thereto.

5. A plurality of balloons filled with air, each balloon having a tail, and a balloon suspension device for forming a cluster of air-filled balloons simulating lighter-than-air balloons comprising an elongated rod having suspension means at one end for suspending the rod substantially vertically, and a plurality of brackets having proximal ends and distal ends with a hole or key-hole slot formed in the proximal ends for slidably mounting the brackets on the rod at the proximal ends thereof for angular and axial adjustment of the brackets on the rod, each bracket having a flange formed at its distal end for removably attaching a balloon thereto, means for removably attaching a balloon to each bracket flange, a weight in the shape of a bow, and a plurality of ribbons for attaching the weight equally taut to the tail of each balloon.

6. A plurality of balloons filled in air and a balloon suspension device as claimed in claim 5 in which the means for removably attaching a balloon to each bracket flange comprises double-sided adhesive tape or hook and loop fasteners.

* * * * *